US006539568B2

(12) United States Patent
Lee, Jr.

(10) Patent No.: US 6,539,568 B2
(45) Date of Patent: Apr. 1, 2003

(54) ORTHOTIC PILLOW

(76) Inventor: Marion O. Lee, Jr., 2233 Arabi Warwick Rd., Cordele, GA (US) 31015

( * ) Notice: Subject to any disclaimer, the term of this patent is extended or adjusted under 35 U.S.C. 154(b) by 0 days.

(21) Appl. No.: 09/758,658

(22) Filed: Jan. 12, 2001

(65) Prior Publication Data

US 2002/0092097 A1 Jul. 18, 2002

(51) Int. Cl.[7] ..... A47G 9/00
(52) U.S. Cl. ..... 5/644; 5/655.3; 5/636
(58) Field of Search ..... 5/636, 644, 645, 5/654, 706, 710, 655.3, 711, 712

(56) References Cited

U.S. PATENT DOCUMENTS

| | | | | | |
|---|---|---|---|---|---|
| 3,416,169 | A | | 12/1968 | Emery | 5/337 |
| 3,864,766 | A | | 2/1975 | Prete, Jr. | 5/337 |
| 4,133,064 | A | | 1/1979 | Petrusek | 5/341 |
| 4,724,560 | A | * | 2/1988 | Christie | 5/644 |
| 5,363,524 | A | | 11/1994 | Lang | 5/640 |
| 5,642,544 | A | | 7/1997 | Munoz | 5/644 |
| 5,771,514 | A | | 6/1998 | Wilhoit | 5/644 |
| 5,898,963 | A | | 5/1999 | Larson | 5/644 |
| 6,131,219 | A | * | 10/2000 | Roberts | 5/636 |

* cited by examiner

*Primary Examiner*—Lynne H. Browne
*Assistant Examiner*—Fredrick Conley
(74) *Attorney, Agent, or Firm*—Baker, Donelson, Bearman & Caldwell

(57) ABSTRACT

An orthotic pillow (10) is disclosed having an outer envelope (11) formed by a top wall (12) and a bottom wall (13), and a tubular, cylindrical interior wall (17) which in combination with the outer envelope (11) defines a central compartment (19) surrounded by a peripheral compartment (20). An unidirectional control valve (21) is coupled to the interior wall (17) to provide a controllable fluid channel between the central compartment (19) and the peripheral compartment (20). The central compartment (19) and peripheral compartment (20) are filled with a fluid which flows from the central compartment to the peripheral compartment to conform to a user's head and neck.

12 Claims, 1 Drawing Sheet

ORTHOTIC PILLOW

TECHNICAL FIELD

This invention relates to pillows, and specifically to pillows which are designed to provide proper alignment of the spine.

BACKGROUND OF THE INVENTION

Pillows have existed for centuries. Typically, a pillow consists of an envelope filled with a soft material, such as down, spun fibers, foam rubber, and the like. While these pillows provide comfort during sleep they also orient the head of person so as to misalign the head with the spine. This misalignment may result in physical problems to the human body.

Recently, pillows have been designed having a top surface contoured in a manner to better align the head and spine during sleep. These pillows however are typically designed with atop surface having one fixed shape. As such, these pillows do not properly conform to all users having different neck lengths, head sizes or other physical differences between individuals.

Contourable pillows have also been designed having an air impermeable outer envelope, an air permeable interior material, and a control valve coupled to the outer envelope which controls the release of air within the outer envelope to ambience, as shown in U.S. Pat. No. 3,864,766. With the application of pressure upon the pillow and the opening of the control valve the interior material compresses in the area of the pressure, thereby forcing the air from that portion of the interior material. With the closing of the valve the interior material is intended to maintain the depressed, air voided area so as to maintain that depressed contour. Realistically however the contour is not maintained since air migrates from the undepressed portion of the interior material to the depressed portion as the user's head moves from one portion of the pillow to another.

Contourable pillows have also been designed wherein opposite sides of the exterior envelope may be secured in different areas to provide a contour, as shown in U.S. Pat. No. 5,363,524. The user of these pillows must estimate the desired contour and then configure that desired contour by manually manipulating the interior material. As such, the pillow still may not provide the correct contour for proper alignment of the head and spine.

Contourable pillows have also been provided having multiple, parallel chambers in fluid communication with each other, as shown in U.S. Pat. Nos. 5,642,544 and 5,898,963. Here, fluid may pass from one chamber to another through an opening extending through a common wall of the chambers. As the fluid may flow back and forth from one chamber to another the contour of the pillow is not maintained as different pressures are applied to different areas of the pillow.

Accordingly, it is seen that a need remains for a contourable pillow which may maintain a configuration adapted for a particular individual even though subsequent movement of the user's head may occur. It is to the provision of such therefore that the present invention is primarily directed.

SUMMARY OF THE INVENTION

In a preferred form of the invention an orthotic pillow comprises a central compartment adapted to hold a fluid, a peripheral compartment adapted to hold a fluid which substantially surrounds the central compartment, and an unidirectional control valve coupled to the central compartment which allows the flow of fluids from the central compartment to the peripheral compartment. With this construction, as the head of a person is placed upon the pillow's central compartment fluid within the central compartment is pressurized causing the fluid to pass through the control valve into the peripheral compartment so as to relieve the pressure upon the head and increase the pressure upon the neck so as to induce proper alignment of the neck during sleep.

DETAILED DESCRIPTION

Figure 1:
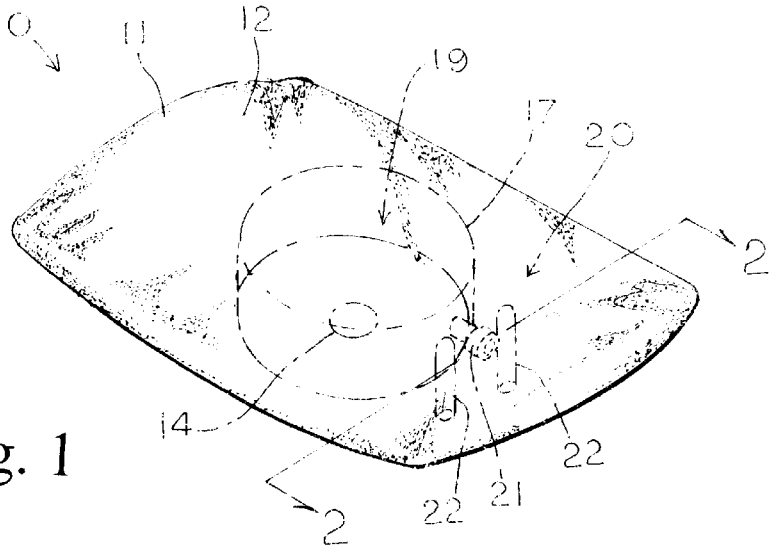
FIG. 1 is a perspective view of an orthotic pillow embodying principles of the invention in a preferred form.
Figure 2:
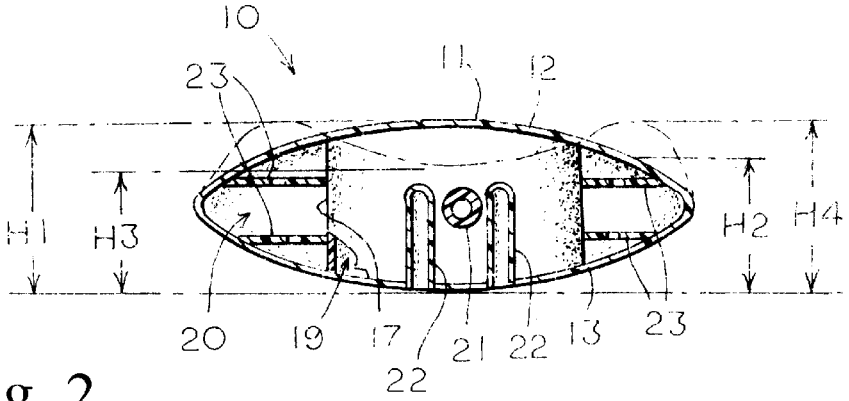
FIG. 2 is a cross-sectional, side view of the orthotic pillow of FIG. 1.

With reference next to the drawings, there is shown an orthotic pillow 10 in a preferred form of the invention. The pillow 10 has a generally rectangular, fluid impervious, pliable, outer envelope 11 formed by a top wall 12 and a bottom wall 13 joined to each other along their periphery. A resealable fill port 14 extends through the bottom wall 13 of the envelope 11. The pillow 10 also has a pliable, tubular, cylindrical interior wall 17 extending from and between the top wall 12 and the bottom wall 13. The combination of the envelope 11 and interior wall 17 form a central compartment or portion 19 surrounded by a peripheral compartment or portion 20.

The pillow 10 also has a unidirectional control valve 21 coupled to the interior wall 17 to provide a controllable fluid channel between the central compartment 19 and the peripheral compartment 20. The control valve 21 may be of conventional construction wherein an unshown flap is positioned within the cylindrical housing in such a manner so as to allow the flow of fluid from the central compartment 19 to the peripheral compartment 20, but which prevents the flow of fluid in an opposite direction unless the cylindrical housing is manually squeezed to displace the flap. A pair of finger channels 22 extend from the bottom wall 13 of the outer envelope 11 to a position adjacent the control valve 21 to provide for manual access and manipulation of the control valve 21. The central compartment 19 and peripheral compartment 20 are filled with a fluid, which may be in either gas or liquid form, through the fill port 14.

In use, with the pillow 10 in an initial, relaxed configuration the pressure between the central compartment 19 and the peripheral compartment 20 is equalized. The pillow central compartment 19 has a height H1 while the peripheral compartment 20 generally has a height H2.

With the positioning of a user's head upon the central compartment 19 of the pillow 10 the fluid pressure within the central compartment 19 increases. This increase in fluid pressure causes a portion of the fluid within the central compartment 19 to flow through the unidirectional control valve 21 and into the peripheral compartment 20 to provide an equalization of fluid pressure. The flow of fluid from the central compartment 19 causes its height to be reduced to height H3, while the height of the peripheral compartment 20 is increased to height H4, i.e. the central compartment lowers while the peripheral compartment rises. This recontouring of the pillow 10 lowers a user's head while simultaneously raising the user's spine adjacent the head, thus inducing a proper alignment of the head and spine during sleep. It should be noted that because the control valve 21 allows only unidirectional flow the central compartment will not rise if the user decreases the pressure thereon through movement of the head.

To return the pillow to its initial, relaxed configuration, the user simply inserts his or her fingers into the finger channels 22 and manipulates the control valve 21 to a bidirectional or reversible position. The reversible position allows for an equalization of the central compartment 19 and peripheral compartment 20 through the flow of fluid from the peripheral compartment back into the central compartment.

The pillow 10 may include baffles 23, in the form of walls having openings therein, which prevent fluid in the form of liquid from bouncing or rocking back and forth within the envelope. Also, the pillow may include unshown sleeves to accommodate ice packs or heat packs.

Figure 3:
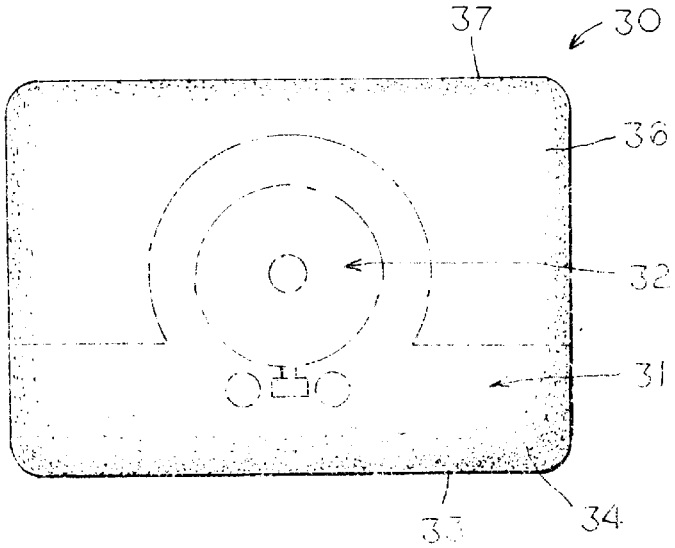
FIG. 3 is a top view of an orthotic pillow embodying principles of the invention in another preferred form.

With reference next to FIG. 3, there is shown a pillow 30 in another preferred form of the invention. Here, the pillow is similar to that previously described except that the peripheral compartment 31 extends about the central compartment 32 and only along the front 33 of the envelope 34. The pillow also includes a stabilizing compartment or portion 36 which extends about a rearward portion of the peripheral compartment 31 and along the rear 37 of the envelope 34. The height of the stabilizing compartment 36 generally does not change with pressure differences upon the central compartment 32. The use of pillow 30 is essentially the same as that previously described.

It should be understood that the peripheral compartment 20 need not completely surround the central portion 19.

It thus is seen that an orthotic pillow is now provided which overcomes problems with those of the prior art. While this invention has been described in detail with particular references to the preferred embodiments thereof, it should be understood that many modifications, additions and deletions, in addition to those expressly recited, may be made thereto without departure from the spirit and scope of the invention as set forth in the following claims.

What is claimed is:

1. An orthotic pillow comprising:

(A) a central compartment adapted to hold a fluid;

(B) a peripheral compartment adapted to hold a fluid, said peripheral compartment substantially surrounding said central compartment; and (C) an unidirectional control valve coupled to said central compartment which allows the flow of fluids from said central compartment to said peripheral compartment, whereby as the head of a person is placed upon the pillow's central compartment fluid within the central compartment is pressurized causing the a portion of the fluid to pass through the control valve into the peripheral compartment so as to relieve the pressure upon the head by decreasing the height of the central compartment and increase the pressure upon the neck by increasing the height of the peripheral compartment so as to induce proper alignment of the neck during sleep.

2. The orthotic pillow of claim 1 further comprising a stabilizing compartment extending from said peripheral compartment.

3. The orthotic pillow of claim 1 further comprising at least one access channel extending into said peripheral compartment which allows manual access of said control valve, whereby a person may manually open the control valve to allow fluid to pass back through the valve from the peripheral compartment to the central compartment.

4. The orthotic pillow of claim 1 further comprising fluid baffles positioned within said peripheral compartments.

5. An orthotic pillow comprising a first compartment made of a pliable material which allows the height of said first compartment to vary between a lowered, relaxed height and an elevated, pressurized height, a second compartment positioned within said first compartment made of a pliable material which allows the height of the second compartment to vary between an elevated, relaxed height and a lowered, pressurized height; and an unidirectional fluid control valve extending between and in fluid communication with said first compartment and said second compartment, whereby with the weight of a person's head placed upon the second compartment fluid within the second compartment flows through the control valve into the first compartment thereby causing the second compartment to move from its elevated height to its lowered height while simultaneously causing the first compartment to move from its lowered height to its elevated height so as to increase the pressure upon the person's neck area.

6. The orthotic pillow of claim 5 further comprising a third compartment extending from said first compartment, whereby the third compartment helps to stabilize the position of the first compartment upon an underlying surface.

7. The orthotic pillow of claim 5 further comprising at least one access channel extending into said first compartment which allows manual access of said control valve, whereby a person may manually open the control valve to allow fluid to pass back through the valve from the first compartment to the second compartment.

8. The orthotic pillow of claim 5 further comprising fluid baffles positioned within said first compartments.

9. An orthotic pillow comprising;

(A) an envelope having a top wall and a bottom wall;

(B) an tubular inner wall extending between said envelope top wall and said envelope bottom wall so as to define a central portion substantially surrounded by a peripheral portion;

(C) an unidirectional control valve in fluid communication with said central portion and said peripheral portion which allows the flow of fluid from said central portion to said peripheral portion; and (D) fluid contained within said central portion and said peripheral portion, whereby pressure upon the central portion causes a portion of the fluid therein to flow to the peripheral portion thereby decreasing the volume of the central portion while increasing the volume of the peripheral portion.

10. The orthotic pillow of claim 9 further comprising a dividing wall extending between said envelope top wall and said envelope bottom wall thereby separating the peripheral portion into a first peripheral chamber and a second stabilizing chamber.

11. The orthotic pillow of claim 9 further comprising at least one access channel extending from said envelope to a position adjacent said control valve to allow manual access of said control valve, whereby a person may manually open the control valve to allow fluid to pass back through the valve from the peripheral portion to the central portion.

12. The orthotic pillow of claim 9 further comprising fluid baffles positioned within said peripheral portion.

* * * * *